US009758934B1

(12) United States Patent
Klemaske, II et al.

(10) Patent No.: US 9,758,934 B1
(45) Date of Patent: Sep. 12, 2017

(54) IMPRINTED CONCRETE WITH EXPOSED AGGREGATE

(71) Applicant: T.B. Penick & Sons, Inc., San Diego, CA (US)

(72) Inventors: Byron A. Klemaske, II, San Diego, CA (US); Victor Alvin Klemaske, San Diego, CA (US)

(73) Assignee: T.B. Penick & Sons, Inc., San Diego, CA (US)

( * ) Notice: Subject to any disclaimer, the term of this patent is extended or adjusted under 35 U.S.C. 154(b) by 0 days.

(21) Appl. No.: 15/178,437

(22) Filed: Jun. 9, 2016

(51) Int. Cl.
*E01C 7/00* (2006.01)
*E01C 7/35* (2006.01)
*E01C 7/32* (2006.01)

(52) U.S. Cl.
CPC ..... *E01C 7/35* (2013.01); *E01C 7/325* (2013.01)

(58) Field of Classification Search
CPC ..... E01C 7/325; E01C 7/35
USPC ..... 404/17, 19, 72, 75
See application file for complete search history.

(56) References Cited

U.S. PATENT DOCUMENTS 9,267,284 B2 * 2/2016 Shaw ..... E04F 15/12
2006/0083591 A1 * 4/2006 Shaw ..... C04B 28/02 405/43
2013/0177354 A1 * 7/2013 Farrell ..... E01C 19/43 404/75

* cited by examiner

*Primary Examiner* — Raymond W Addie
(74) *Attorney, Agent, or Firm* — Knobbe Martens Olson & Bear LLP

(57) ABSTRACT

Systems and methods of imprinting concrete having exposed aggregate. The imprinted concrete system comprises a concrete layer, an imprinted layer disposed on the concrete layer, wherein the imprinted layer comprises a decorative aggregate, and has been imprinted with an imprinting tool. In some embodiments, the decorative aggregate may be at least partially exposed.

6 Claims, 9 Drawing Sheets

IMPRINTED CONCRETE WITH EXPOSED AGGREGATE

BACKGROUND

Field

The present disclosure relates to an imprinted concrete system having exposed aggregate, and a method of forming the same.

Description of the Related Art

Stamped or imprinted concrete is used in landscape or flooring applications. Stamped or imprinted concrete is frequently intended to be shaped or textured like tile, cobblestone, etc., but generally requires a shiny, non-realistic sealer as a finish, does not look real, and requires frequent maintenance. Moreover, traditional stamped or imprinted concrete does not wear well, degrading and breaking down easily, because the material which makes up the imprint, stamp, or texture is composed primarily of cement paste and/or fines. The cement paste and/or fines tend to break, chip, crack or otherwise slough off relatively quickly, particularly in flooring applications. Therefore, the need exists for a stamped or imprinted-type concrete material which provides a realistic look, a stone-like look, wears well, and which does not require frequent maintenance.

SUMMARY OF THE INVENTION

In one aspect described herein, an imprinted concrete system has and exposed aggregate and comprises a sub-grade layer; a concrete layer, disposed on the sub-grade layer, comprising a coarse aggregate, a cement mixture, and water of hydration; an imprinted layer disposed on the concrete layer, comprising a decorative aggregate, a retarder, and a sealer distributed throughout the imprinted layer; and wherein the imprinted layer has a textured or patterned surface, formed by contact with an imprinting tool, and wherein at least a portion of the decorative aggregate in the imprinted layer is exposed.

In some embodiments, the imprinted layer comprises a top portion of the concrete layer. In some embodiments, the imprinted layer further comprises a sealer. In some embodiments, the imprinted layer further comprises an alkali silica reactivity control admixture. In some embodiments, the alkali silica reactivity control admixture comprises lithium nitrate. In some embodiments, the decorative aggregate has an average particle diameter of from about 1/16 inch to 3/8 inch. In some embodiments, the decorative aggregate comprises two or more different types of aggregate having varying average particle diameters. In another aspect described herein, a method of forming an imprinted concrete system having exposed aggregate comprises disposing a concrete layer on the sub-grade layer, wherein the concrete layer comprises a cement, a relatively coarse aggregate, and water of hydration; finishing the concrete layer to form a top surface of the concrete layer; forming an imprinted layer, the imprinted layer comprising a decorative aggregate, wherein forming the imprinted layer comprises imprinting the surface of the concrete layer using an imprinting tool; retarding curing of a top surface of the imprinted layer by applying a retarder, and allowing a remaining portion of the imprinted layer to cure to a greater extent than the top surface; and waiting a predetermined time; and thereafter mechanically removing at least a portion of the top surface of the imprinted layer to at least partially expose the decorative aggregate; and washing the imprinted layer.

In some embodiments, allowing a remaining portion of the imprinted layer to cure to a greater extent than the top surface comprises waiting a predetermined period of time between applying the retarder and mechanically removing the at least a portion of the top surface.

In some embodiments, the predetermined time is based on a characteristic of the decorative aggregate. In some embodiments, the decorative aggregate is broadcast onto the concrete layer. In some embodiments, the concrete layer further comprises a sealer. In some embodiments, the concrete layer further comprises an alkali silica reactivity control admixture. In some embodiments, mechanically removing comprises brushing the surface of the imprinted layer. In some embodiments, at least partially exposing the decorative aggregate comprises exposing at least a top surface of the decorative aggregate.

DETAILED DESCRIPTION

Figure 1:
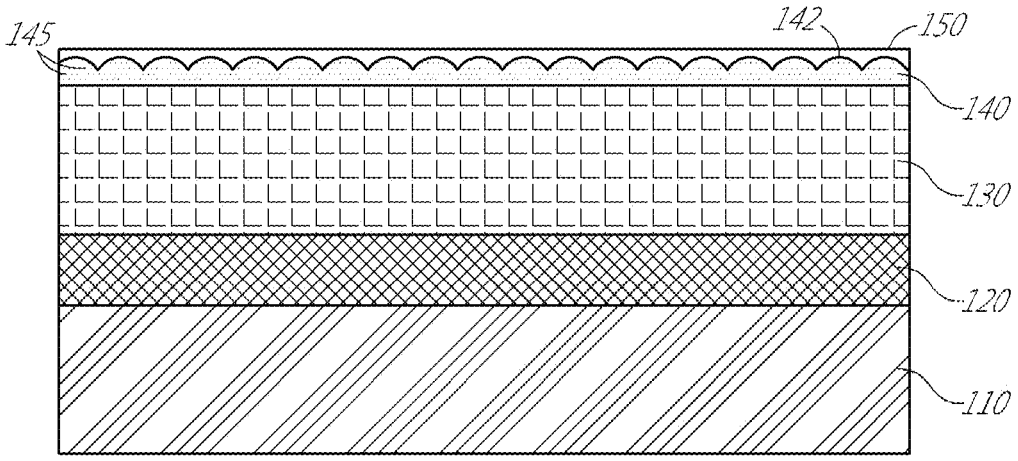
FIG. 1 depicts a cross-sectional view of an embodiment of an imprinted concrete having exposed aggregate.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented herein. It will be readily understood that the aspects of the present disclosure, as generally described herein, and illustrated in the Figures, can be arranged, substituted, combined, separated, and designed in a wide variety of different configurations, all of which are explicitly contemplated herein.

Disclosed in the present application is an imprinted concrete system having exposed aggregate and a method for forming an imprinted concrete having exposed aggregate.

Although certain embodiments of the present invention are shown and described in detail, it should be understood that various changes and modifications may be made without departing from the scope of the appended claims. The scope of the present application is in no way limited to the number of constituting components, the materials thereof, the quantities thereof, the relative arrangement thereof, etc. Generally, the term cement is used to denote the material used to bind together the aggregate materials in concrete. For example, herein the term cement may refer to a mixture comprising portland cement, hydrated lime, calcium aluminate cement, calcium sulfoaluminate cement, pozzolan-lime cement, or any other commonly known or used cement in masonry, concrete, grout, plaster, or any combination of the foregoing. Also, it is contemplated that some embodiments may not include all of the recited materials, thus sub-combinations of the listed materials are contemplated. For example, certain materials, including one or more of the fiber material, the pozzolan, the internal curing admixture, and the hydration stabilizer may be substituted by other materials or simply eliminated in certain specific embodiments. The term average particle size may mean the average size of the particles measured along an axis when the particles are not substantially round or spherical. Average particle size may mean a spherical equivalent diameter obtained by methods well known in the art for estimating particles as being substantially round or spherical. Average particle size may additionally refer to an industry standard measurement. For example, a coarse aggregate may be labeled or referred to by those in the art or industry as a 1-inch coarse aggregate. In a 1-inch coarse aggregate, many particles of the aggregate may have a size of about 1 inch, but 1 inch is not necessarily the true average particle size in the 1-inch coarse aggregate. As used herein, the term "imprinted concrete" may be used to mean concrete which has had a pattern, shape, or form, imprinted, stamped, textured, stenciled, or finished into the concrete.

Embodiments of the imprinted concrete system having exposed aggregate may comprise an imprinted concrete with desirable aesthetic qualities and desirable wear properties, and may require minimal maintenance, particularly as compared to conventional stamped or imprinted concrete. For example, imprinted concrete having exposed aggregate can provide a durable, realistic, stone-like finish to concrete.

Referring to the Figures, FIG. 1 depicts a cross-sectional view of an embodiment of an imprinted concrete system 100. Imprinted concrete system 100 may be an imprinted, stamped, or otherwise textured concrete having an exposed aggregate. Imprinted concrete system 100 comprises a sub-grade layer 110, a sand layer 120, a concrete layer 130, a top layer 140, and a seal layer 150.

Sub-grade layer 110 can be any suitable base layer on which concrete can be formed. Sub-grade layer 110 may comprise gravel, soil, sand, clay, or other suitable material. Sub-grade layer 110 may be prepared for use by tamping, compressing, treating with a pozzolan, cement or suitable material, or by another appropriate method. The sub-grade layer 110 can be formed, built up, or can be native soil.

Sand layer 120 is formed on subgrade layer 110 by applying a layer of sand to the subgrade layer 110. Sand layer 120 provides support for the layers disposed on top of the sand layer 120. In some embodiments, sand layer 120 may be omitted.

Concrete layer 130 is disposed on sand layer 120. In some embodiments, concrete layer 130 may be disposed directly on subgrade layer 110. Concrete layer 130 comprises a concrete mixture and a reinforcing material (not shown). The concrete mixture may comprise a cement, a coarse aggregate, a fine aggregate, an internal hydration stabilizer, water of hydration, an internal curing admixture, and a cement to bind and harden concrete layer 130. Coarse aggregate may comprise rock, gravel, crushed stone, slag, manufactured rock, or other suitable material, whether natural, manufactured, or recycled. The size of coarse aggregate may vary. In some embodiments, the average particle size of coarse aggregate may be from about ¼" to about 1½" or larger. In some embodiments, an aggregate having an average particle diameter of about ⅜" may be used.

The reinforcing material disposed within concrete layer 130 provides greater provide greater strength, flexibility, durability, or resistance to cracking. In some embodiments, the reinforcing material may comprise rebar, steel plates, a net or mesh, or a fiber material disposed within concrete layer 130.

The hydration stabilizer preserves the workability of the concrete layer by slowing the hydration and curing of the cement. The hydration stabilizer may comprise an aqueous solution of one or more hydroxycarboxylic acids and/or their associated acid salts. The hydroxycarboxylic acid may be citric acid, lactic acid, ascorbic acid, or salts thereof, or any other hydroxycarboxylic acid or salt thereof known in the art. The hydration stabilizer may comprise an aqueous solution of a phosphoric acid, a phosphoric acid salt, or a non-alkaline salt. In some embodiments, the hydration stabilizer may be RECOVER® hydration stabilizer manufactured by Grace Concrete Products.

Concrete layer 130 may comprise an internal curing admixture. The internal curing admixture helps reduce shrinking and cracking during curing, and contributes to desirable characteristics of an imprinted, stamped, or textured concrete, such as color retention and stronger, sharper corners and edges, compared to an imprinted, stamped, or textured decorative concrete without an internal curing admixture. Concrete layer 130 may comprise from about 0 gallons/yard$^3$ to about 5 gallons/yard$^3$ of internal curing admixture. In some embodiments, concrete layer 130 may comprise from about 8 ounces/yard$^3$ to about 10 ounces/yard$^3$. In some embodiments, concrete layer 130 may preferably comprise about ½ pound/yard$^3$ of internal curing admixture In some embodiments, the internal curing admixture may be HydroMax® from ProCure Systems.

The concrete mixture may comprise a pozzolan such as Class C fly ash, Class F fly ash, slag, rice hull ash, silica fume, metakaolin, or other suitable pozzolan. The presence of a pozzolan in concrete layer 130 mitigates the undesirable ASR (alkali silica reaction) which may cause undesirable expansion, swelling, cracking, or spalling of concrete layer 130. Incorporation of a pozzolan, such as fly ash, to mitigate ASR allows for a greater range of aggregate to be useable in concrete layer 130 or imprinted layer 140. Because glass is silica based, the presence of a decorative glass in concrete layer 130 or imprinted layer 140 may increase the occurrence of ASR. By adding a pozzolan such as fly ash, a decorative glass may be used in concrete layer 130 or imprinted layer 140 without experiencing significant undesirable consequences due to ASR.

In some embodiments, the concrete mixture comprises a lithium admixture. The lithium admixture maybe incorporated integrally into the mixture such that it is substantially uniformly distributed throughout concrete layer 130. The lithium admixture may be Euro Arc from Euclid Chemicals or MasterLife ASR 30 from BASF. The lithium-based sealer may be effective to control an alkali silica reaction (ASR), alone or in combination with the pozzolan. The lithium admixture may help mitigate against the undesirable effects of ASR. Inclusion of a lithium admixture which mitigates ASR allows for a greater range of aggregate to be used in concrete layer 130. In some embodiments, the lithium admixture may be applied to the surface of imprinted layer 140 and the exposed aggregate thereof. The lithium admixture may comprise a lithium admixture may also be that manufactured by SINAK under the trade name HLQ-125™.

In some embodiments, the concrete layer 130 may comprise a coloring agent. The coloring agent may be an integral coloring agent, such as a powder incorporated into the concrete mixture. The coloring agent may be a liquid or dry shake color hardener which is applied to the concrete layer 130. The liquid or dry shake color hardener may be applied mechanically or by hand. In some embodiments, the coloring agent can be a coloring agent provided by Lm Scofield, Solomon, Davis Colors, Butterfiled, or ChemSystem.

The concrete mixture may be a 2500-3000 psi concrete mixture, but embodiments are not limited thereto. The concrete mixture may have a slump of about 4 inches to about 6 inches. The thickness of the concrete layer 130 is related to the strength of imprinted concrete system 100. As the thickness of concrete layer 130 increases, the strength of imprinted concrete system 100 increases. For example, for a pedestrian walkway, patio, courtyard, or driveway, the concrete layer 130 may be about 4 inches thick. For a surface subjected to heavy vehicular traffic, a street, crosswalk, commercial driveway, firelane, and the like, the concrete layer 130 may be from about 6 inches to about 8 inches thick.

Imprinted layer 140 comprises a concrete mixture, a decorative aggregate 145, an imprinting, stamp, or texture, and a retarder. In some embodiments, the concrete mixture imprinted layer 140 comprises an upper portion of concrete layer 130. In this arrangement, the concrete mixture of imprinted layer 140 is the same composition as the concrete mixture of concrete layer 130. Thus the components of the concrete mixture of concrete layer 130 provide the same properties and beneficial features with regard to imprinted layer 140 as they do in concrete layer 130. For example, as described above, the concrete mixture of concrete layer 130 comprises an integral sealer; this sealer would also comprise the concrete mixture of imprinted layer 140. This layer is called the imprinted layer 140 because it is the layer which is ultimately imprinted, textured, formed, carved, sculpted, has a pattern, texture, or design otherwise imparted to it. The description below may refer to the top layer of the concrete system as the imprinted layer 140 before the imprinted layer 140 is actually imprinted for ease of discussion. Thus, the top layer of the concrete layer 130, or a separate layer, is termed an imprinted layer 140 both before and after imprinting occurs.

In some embodiments, imprinted layer 140 may be separately applied to concrete layer 130 while concrete layer 130 is at various states of cure. In some embodiments, the concrete mix of imprinted layer 140 may be similar to that of concrete layer 130 with the exception of the aggregate. For example, concrete layer 130 may comprise a coarse aggregate, and imprinted layer 140 may comprise a decorative aggregate 145.

Imprinted layer 140 comprises a decorative aggregate 145. Decorative aggregate 145 may be broadcast onto the surface of imprinted layer 140 (or onto the surface of concrete layer 130, thereby forming part of imprinted layer 140) while imprinted layer 145 is fresh, or has proceeded to predetermined state of cure. A particular look or property can be imparted to the concrete by broadcasting decorative aggregate 145 onto the imprinted layer 140 at a specific state of cure. In some embodiments, the decorative aggregate 145 may be broadcast or seeded onto the surface of imprinted layer 140 from immediately after pouring until about 1 hour after pouring. Broadcasting the decorative aggregate 145 can include spreading or scattering the decorative aggregate 145 uniformly or evenly across the surface of the concrete layer 130 or the imprinted layer 140, and can include placing the aggregate in a specific pattern on the concrete layer 130 or the imprinted layer 140.

in some embodiments, the decorative aggregate 145 is added immediately following a first or initial finishing step, such as a bull floating step. In some embodiments, the decorative aggregate 145 is added after a second finishing step, such as troweling, immediately before imprinting the imprinted layer 140. In some embodiments, the decorative aggregate can be applied to the imprinted layer 140 about 1 to 2 hours after initially placing the concrete layer 130. In some embodiments, the decorative aggregate is applied after 4 hours has elapsed since pouring. Smaller aggregates, such as #00, #01, #1, and #2 can be applied after the initial finishing step, and prior to a second finishing step, which will be described in greater detail below. Smaller aggregates are added after the initial finishing step, and before a second finishing step in order to incorporate the smaller aggregate into the imprinted layer 140 with the cement paste and fines, so the aggregate can form a strong and aesthetically pleasing surface, such as a stone-like or granite-like appearance upon subsequent washing, which will be described below. Additional or larger aggregates can be added after the second finishing step and prior to imprinting. The decorative aggregate 145 can be hand seeded or mechanically seeded onto the imprinted layer 140. In some embodiments, broadcasting or seeding the decorative aggregate 145 occurs before the imprinted layer 140 is imprinted or textured, as will be described below.

Decorative aggregate 145 may have an average particle size less than the average particle size of the coarse aggregate in concrete layer 130, and may comprise particles having a very small size, such as sand or fine gravel that is 1/10 inch or less. In some embodiments, the average particle size of the decorative aggregate 145 may be from less than about 3/16 inch to 3/8 inch. In some embodiments, the decorative aggregate 145 may be a #00 through #8 aggregate as defined by the National Terrazzo and Mosaic Association (NTMA). In some embodiments, the decorative aggregate 145 may comprise mainly #00 through #2 aggregates. Larger number aggregates, such as #3 through #8, may be used, but preferably in a mixture together with a lower number aggregate, such as #00 through #2. The decorative aggregate may comprise volcanic rock, polished rock, basalt, quartz, granite, limestone, crushed stone, sea shells, carbide, amber, aquarium rock, tile, glass, colored glass, or other material. The list of decorative aggregates presented here is illustrative. A person having skill in the art will understand that many other materials may be suitably used as decorative aggregate without departing from the scope of this disclosure. Where the decorative aggregate 145 has a high silica content, such as glass, the imprinted layer 140 can be formed as described above, having lithium-based sealer, or a pozzolan, or both to mitigate ASR.

In some embodiments, more than one type of decorative aggregate may be used in imprinted layer 140. In some embodiments, decorative aggregate 145 may comprise one type or size of decorative aggregate in combination with another type or size of decorative aggregate. For example, decorative aggregate 145 may comprise a mixture of glass aggregate and granite aggregate.

Decorative aggregate 145 may be arranged within or on imprinted layer 140 to create patterns, shapes, pictures or other similar design features on the concrete surface. In some embodiments, an imprinted concrete system comprises an imprinted layer 140 having varying decorative aggregates 145 arranged to form a desired shape or pattern. The pattern of the decorative aggregates may coincide with the pattern of the imprint, stamp, or texture applied to the surface of the imprinted layer 140. In some embodiments, the shape or pattern of the decorative aggregate may highlight, emphasize or otherwise complement the imprint, stamp, or texture. In some embodiments, the decorative aggregate may be substantially uniformly distributed to provide a substantially uniform surface pattern.

In some embodiments, a decorative aggregate may not be broadcast onto the surface of the concrete layer 130 or imprinted layer 140. In this case, the decorative aggregate 145 may be the coarse or fine aggregate which comprises concrete layer 130, or it may be an additional aggregate added in addition to the coarse or fine aggregate.

Imprinted layer 140 comprises an imprint 142. For ease of discussion, imprinting, stamping, texturing, embossing, carving, or sculpting of the concrete surface are referred to herein as imprinting, all of which can form the imprint 142. Imprinting may be done by hand, using stamps or stamp mats, imprinting tools, textured mats, skins, or embossing tools. Imprints, stamps, or textures may be of a variety of patterns or shapes. For example, the imprints or stamps may impart a tile, herringbone, brick, slate, cobblestone, wood, stone, fish scale, rock, or a custom pattern or shape to the imprinted layer 140. The texturing mats or skins may impart a slate, marble, brick, grass, swirls, arcs, or many other textures. Concrete imprints or stamps have raised patterns which, when pressed into recently poured concrete leave a shape or pattern imprinted in the concrete. Texture mats employ the same principle, but generally impart a surface texture to the concrete, rather than a distinct imprint or shape. The imprint, stamp, or texture mat or tool is applied to the surface of imprinted layer 140, or to the surface of concrete layer 130, where the concrete layer 130 and the imprinted layer 140 are the same composition, thereby forming part of imprinted layer 140. The imprint, stamp, or texture is applied to the concrete surface after the concrete has been allowed to set to a certain degree. Specifically, the concrete should be at a state of cure where it is still malleable, formable, and imprintable, but should have a state of cure sufficient to allow the concrete to retain the imprint, stamp, or texture applied. In some embodiments, the imprinting of imprinted layer 140 is performed immediately, about 1 hour, about 2 hours, up to about 4 hours after pouring the concrete. The timing of the imprinting will be described in greater detail below with regard to FIG. 2. Imprinted layer 140 is formed by using one of the above described imprints, stamps, or textures, or any other suitable type of known imprint, stamp, or texture.

Imprinted layer 140 also comprises a retarder. The retarder is applied to the top surface of the concrete layer 130, or to the imprinted layer 140. The retarder can be sprayed on mechanically or by dispersed by hand, and be applied uniformly, or in a desired pattern. The retarder acts to slow the hydration and curing of at least a top portion of the imprinted layer 140, which will facilitate removal for exposing decorative aggregate 145. The retarder may comprise a polymer based surface retarder. The amount of retarder applied will affect the imprinting and exposed aggregate character of the concrete. The amount of retarder applied will also affect the depth of penetration of the retarder. In the case where a larger aggregate is used, it may be desirable for the retarder to penetrate to a greater degree in order to allow more of the aggregate to be exposed, or to allow an imprinting to form a deeper imprint. Where a smaller decorative aggregate 145 is used, such as a #00, #01, #1, or #2 aggregate, a lesser amount of retarder can be applied, or can be applied with a shallower depth of penetration. In some embodiments, the retarder can be applied at any time from about 15 minutes to about 4 hours after imprinting the imprinted layer 140. The time of applying the retarder can vary based on the desired exposure of the decorative aggregate 145. For example, applying the retarder at around 15 minutes from imprinting, will result in more aggregate, or more of each particle of decorative aggregate being exposed upon subsequent washing. Applying the retarder at about 4 hours will result in less aggregate exposure.

Seal layer 150 may be applied to imprinted layer 140. Seal layer 150 may comprise a lithium-based sealer such as that manufactured by SINAK under the trade name HLQ-125™ or Cure 1000. In some embodiments, decorative aggregate 145 is exposed via a process describe elsewhere herein such that the top surface of decorative aggregate is exposed. Decorative layer sealer 150 may be applied to the top surface of imprinted layer 140 and the exposed top surfaces of decorative aggregate 145. In some embodiments, as described elsewhere herein, the sealer may be integrally mixed with the concrete layer 130 and/or imprinted layer 140. The seal layer 150 can mitigate undesirable ASR reaction and provide a protective surface for the imprinted layer 140. In some embodiments, the seal layer 150 is sprayed on at a rate of about a gallon per 200-300 square feet. In some embodiments, one or two coats of sealer may be applied to form the seal layer 150. The sealer absorbs into the concrete layer 130 and/or the imprinted layer 140 providing decreased permeability and sorptivity of the concrete. This protects against chloride ion penetration, freeze/thaw damage, and provides increased stain resistance.

Figure 2:
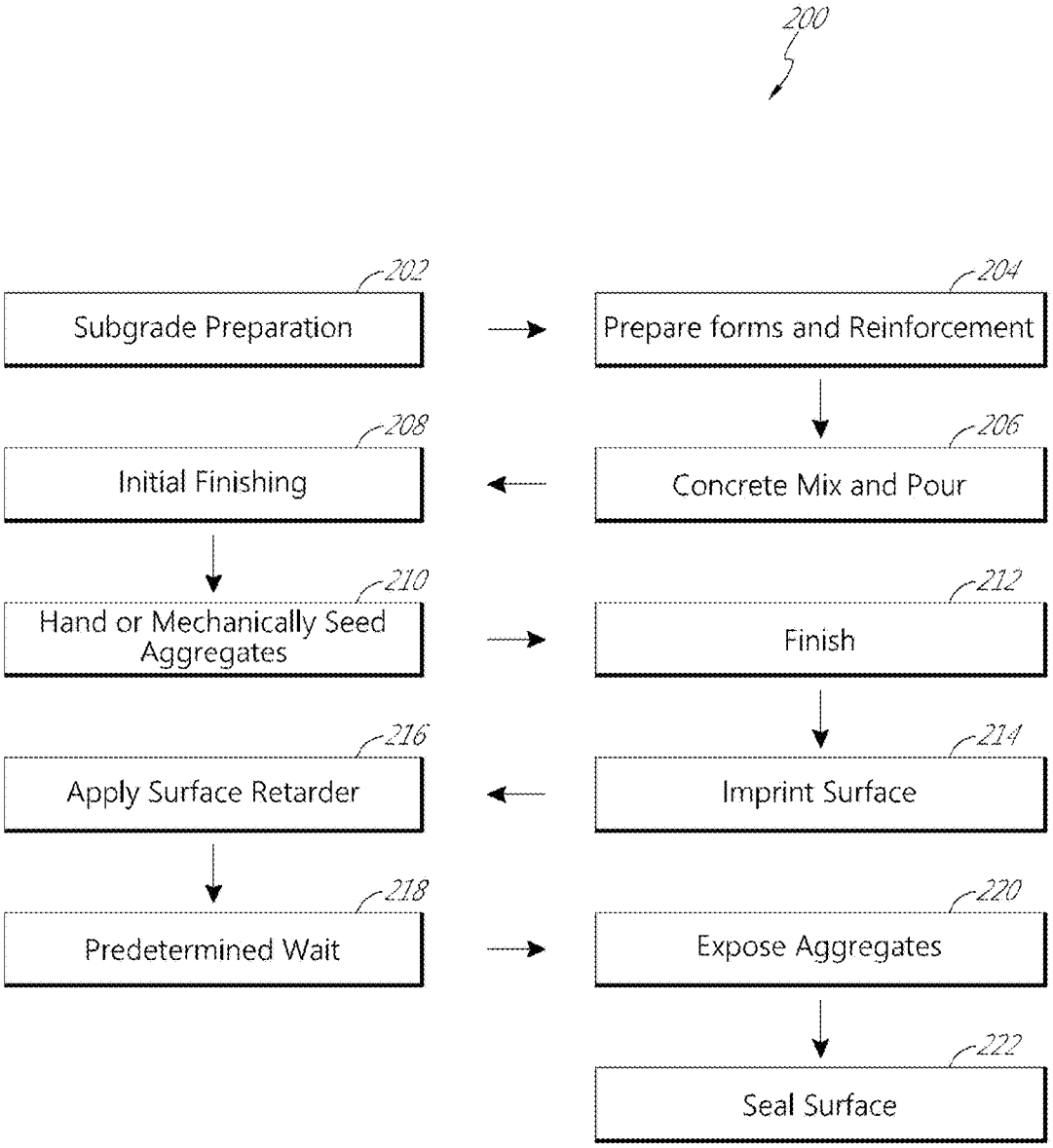
FIG. 2 depicts an embodiment of a method for forming an imprinted concrete having exposed aggregate.

FIG. 2 is a flow chart of a method for preparing an imprinted concrete having exposed aggregate. Process 200 begins at step 202 wherein the subgrade layer 110 is prepared. The subgrade layer 110 is prepared based on the intended application for the imprinted concrete. The subgrade base may comprise soil, gravel, crushed rock, or other suitable material as described elsewhere herein. The subgrade base is prepared and may be graded, trenched, or otherwise formed to ensure there is sufficient structural support for the imprinted concrete. For example, subgrade layer 110 may be formed compacting and leveling the native soil.

After the subgrade layer 110 is prepared in step 202, sand layer 120 is placed on top of subgrade layer 110. Sand layer 120 is formed by pouring sand to a depth of 2 to 4 inches onto the sub-grade layer 110 or the native base. The sand is leveled and prepared for the subsequent layers of the imprinted concrete system 100. In some embodiments of forming the imprinted concrete system 100, the sand layer 120 may be omitted.

In step 204, forms are prepared and/or put in place, and a rebar or wire mesh reinforcement may be installed. The reinforcement provides structural support and stability to the concrete layer 130. The rebar or wire mesh may be placed with the forms so that the reinforcement is embedded in concrete layer 130 after the concrete is poured into the forms and onto the rebar or wire mesh. In some embodiments, the rebar or wire mesh may be omitted.

Process 200 then moves to step 206, wherein concrete layer 130 is placed on sand layer 120, or in embodiments where sand layer 120 is absent, on subgrade layer 110. Concrete layer 130 is poured to a desired thickness. Concrete layer 130 may be poured, for example, from 1 inch to 10 inches thick. In some embodiments, concrete layer 130 may be poured 4 inches thick. After pouring concrete layer 130, the process 200 moves to step 208 wherein the concrete layer 130 is initially finished, by screeding, and/or floating using a bullfloat or any other similar desired tool. In some embodiments, a top portion of the concrete layer 130 becomes the imprinted layer 140. In some embodiments, another layer of concrete, which can have a different aggregate or different size of aggregate, can be poured onto the concrete layer to form imprinted layer 140. The imprinted layer 140 can then be initially finished by screed or bullfloat.

After initially finishing concrete layer 130 in step 208, decorative aggregate 145 is broadcast onto the concrete layer 130 in step 210. Broadcasting decorative aggregate 145 may be performed from immediately following initial finishing in step 208 to about 1 hour after initial finishing step 208. Preferably, broadcasting the decorative aggregate in step 145 occurs within about 30 minutes of the initial finishing step 208. By this time, the majority of bleed-water from placing the concrete layer 130 and/or imprinted layer 140 will have dissipated, and the imprinted layer 140 will be able to receive the decorative aggregate 145. In some embodiments, broadcasting decorative aggregate 145 in step 210 is performed hours after completion of initial finishing. Decorative aggregate 145 may be any aggregate as descried elsewhere herein, and may be broadcast by hand or by a mechanical method, such as a sprayer, or other desired distribution tool. Decorative aggregate 145 may be any aggregate as described elsewhere herein. Decorative aggregate 145 may be uniformly distributed over the top surface of concrete layer 130, or may be distributed in a pattern. In some embodiments, more than one type of decorative aggregate may be used to achieve a desired pattern or design of aggregate for the imprinted concrete.

In some embodiments, decorative aggregate 145 is not broadcast onto the imprinted layer, but a decorative aggregate 145 is mixed in with the concrete and poured with the concrete layer 130 and the imprinted layer 140. In this embodiment, the aggregate of the concrete mixture becomes the decorative aggregate which is exposed as will be described later herein.

After decorative aggregate 145 is broadcast in step 210, process 200 moves to step 212, wherein the concrete layer 130 undergoes a second finish step, which can include bull floating and/or troweling. Floating the concrete layer 130 in step 212 may help to ensure the decorative aggregate broadcast in step 210 is sufficiently adhered to or disposed within the upper surface of concrete layer 130.

The process 200 next moves to step 214, wherein the concrete layer 130 is imprinted to form imprinted layer 140. In some embodiments, to form the imprinted layer 140, a waiting period elapses. When the desired imprinting is a deep imprint, for example, about ¾ inch or about, 1 inch), the imprinting takes place after the second finishing step 212, and from about 1 to 3 hours after initial placement of the concrete layer 130 or imprinted layer 140. Where a textured imprint, or an imprint shallower than a deep imprint, is desired, the imprinting takes place after the second finishing step 212, and from about 1 to 4 hours after initial placement of the concrete layer 130 or imprinted layer 140. If the surface of the imprinted layer 140 is too wet when the imprinting tool is applied, a stippled surface may result when removing the imprint tool. After the times described above have elapsed, a release agent can be applied to the concrete layer 130. The release agent can ensure that the imprinting tool can be removed from the surface of concrete layer 130 without sticking to and marring, defacing, or deforming, or the newly created imprinted layer 140. To form imprinted layer 140, an imprinting tool, such as a stamp, stamp mat, textured mat, skin, embossing tool, wood, or hand tools, or any other desired tool or apparatus, is used. The imprinting tool is placed on concrete layer 130, with the release agent disposed therebetween, and pressure is applied to the imprinting tool to ensure the contours, designs, patterns, or the like, of the imprinting tool are imparted to the concrete surface. While using a bladed or cookie cutter type imprinting tool, only the blades should contact the surface of the imprinted layer 140. In some embodiments, once imprinted layer 140 is formed in step 214, the concrete surface is not floated, troweled, or screeded again, as such an action could undesirably alter, change, obliterate, or destroy the imprinted pattern on imprinted layer 140, formed in step 214.

The type of imprinting or depth of imprint is chosen, in part, based on the decorative aggregate 145 to be used. Where the decorative aggregate 145 has a small average particle size, such as a #00-#3. Where the aggregate is larger, for example a #6, #7 or #8, or larger, a shallower imprint or texture may be desired, to avoid uncovering too much of the particles of aggregate such that they make break free from the surface of the concrete after curing. In some embodiments, textured imprinting is used for the imprinted layer 140 when a larger aggregate is applied to the mix. A textured imprint can be, for example, an Ahslar pattern, a seamless texture skin, travertine pattern, random stone, flagstone, sidewalk slate, granite, granite setts. Where a bladed, cookie-cutter type imprint is used, a smaller aggregate is preferable. For example, when using a cookie cutter type imprint to impart a brick or cobblestone like appearance, the aggregate is preferably smaller than ⅜". The bladed imprints can impart patterns such as flagstone, river rock, cobblestone, fan pattern, random stone, brick, or slate.

In some embodiments, and as described elsewhere herein, imprinted layer 140 may be formed as a separate concrete mixture which is applied to concrete layer 130. The imprinted layer 140 can be applied to the concrete layer 130 after all, or a majority of the bleed water has dissipated from the concrete layer 130. Thus, in some embodiments, the concrete mixture of the imprinted layer 140 may comprise the desired decorative aggregate 145, and a separate decorative aggregate may not need to be broadcast onto the concrete layer 130 as described elsewhere herein. The decorative aggregate 145 can comprise the aggregate in the concrete mix of the imprinted layer 140. In this embodiment, therefore, the imprinting tool will be applied to the surface of the imprinted layer 140, and the imprinting is performed as described herein.

After forming imprinted layer 140 in step 214, the process moves to step 216, wherein a retarder is applied to the surface of imprinted layer 140. A retarder may be applied to facilitate the subsequent exposure of decorative aggregate 145. In some embodiments, the retarder is applied to the surface of imprinted layer 140 within about 30 minutes of forming imprinted layer 140. The retarder acts to slow the hydration and curing of at least a top portion of the imprinted layer 140, which will facilitate removal of cement paste and/or fines for exposing decorative aggregate 145. The retarder is applied by uniformly to the surface of imprinted layer 140. In some embodiments, the retarder is applied using a Hudson-type sprayer or using a low flow automatic pump sprayer with an adjustable nozzle. The retarder can be applied at a rate of about 1 gallon per 200 to 300 square feet. In some embodiments, the retarder may be applied non-uniformly, such as in a pattern or in a design which allows for exposure of decorative aggregate according to a pattern or design.

The retarder and/or the amount of retarder, and timing of retarder application is chosen based on the desired depth of etch, or, in other words, the amount of decorative aggregate 145 to be exposed. In some embodiments, the depth of etch is chosen based on design or ornamental choice, or as a complement to the imprinted texture or pattern in imprinted layer 140. In some embodiments, the depth of etch may be chosen to meet a standard, such as for accessibility under state or federal law, or according to any other standard set by a contractor, customer, or other entity. The retarder may comprise a polymer based surface retarder. The depth of etch can be controlled by controlling the amount of retarder used, by the concentration of the retarding agent, or by the type or retarder chosen. The retarder used may be one of several commercially available retarders, such as Rugasol®, or a retarder manufactured by Euclid, Butterfield, or may be any other desired retarder.

The more moisture present in the concrete layer 130 or imprinted layer 140, the deeper the retarder penetrates the surface. A drier concrete layer 130 or imprinted layer 140 would result in a shallower depth of etch, as the retarder does not penetrate as deeply in the drier concrete. Therefore, when using a large aggregate, the retarder can be applied much earlier than for a smaller, sand-type aggregate. If a deep etch is desired, such as when a large aggregate is used, the retarder can be applied immediately following imprinting in step 214. By applying the retarder immediately following imprinting in step 214, the retarder is applied while the concrete is more wet or moist, and more of the decorative aggregate 145 will be exposed upon exposure of the aggregate, or washing. When using a smaller aggregate, such as a sand-type aggregate, the retarder is applied after waiting a period of time from imprinting in step 214. By applying the retarder at a time after the imprinting step 214, the concrete surface is drier, which creates a lighter etched surface with the smaller aggregate and natural fines from the concrete layer 130 or imprinted layer 140. In any event, the concrete layer 130 or imprinted layer 140 should be free from bleed water before applying the retarder.

After applying the retarder in step 216, the process 200 moves to step 218, wherein a predetermined time is allowed to pass. The predetermined time is chosen according to the type of decorative aggregate 145 used and the desired texture. The predetermined time can also be based on environmental factors such as the outside temperature, humidity, cloud cover, and precipitation. For example, the aggregate may be exposed within about 1-2 hours or up to about 16 hours from the application of retarder in step 216. The depth of etch, or the amount of aggregate exposed, can be affected by the amount of time the retarder is left on imprinted layer 140 prior to exposing the decorative aggregate 145. For example, if a deeper depth of etch is desired, the time between applying the retarder and exposing the aggregate may be increased. As used herein, a higher number on a retarder is a retarder that results in a deeper etch, or which retards curing of cement to a greater extent than a lower numbered retarder. For a deeper etch, a #5-#10 retarder can be applied and the surface washed the same day as placing the concrete and applying the retarder. For a medium etch, a #3 to #6 retarder can be applied and the surface can be washed the morning following the placement of concrete and application of retarder. For a light etch, a #1 retarder can be applied to the concrete surface, and the surface can be washed the next morning, or midmorning, e.g., 8 to 10 am, following the placement of the concrete. In some embodiments, the combination of retarder and time of cure can be varied or used in combination to achieve the desired depth of etch.

After waiting the predetermined time, in step 220, the decorative aggregate 145 is exposed. The decorative aggregate may be exposed by removing at least a top portion of imprinted layer 140 by brushing, sweeping, spraying, sponge rolling, water blasting, or other similar method. A sufficient amount of imprinted layer 140 is removed in order to reveal at least the top surface of the particles of decorative aggregate 145. Once at least a top portion of imprinted layer 140 is removed, portions of the particles of decorative aggregate 145 become visible on the surface of decorative porous layer 140. After exposing decorative aggregate 145, imprinted layer 140 is washed to remove dirt, debris, loose concrete, and other material that may be on the surface of imprinted layer 140. Care must be taken during step 220 not to flatten, destroy, deface, change, or otherwise alter the imprinted texture or pattern applied in step 214. After exposing the aggregate in step 220, the concrete is allowed to cure. In some embodiments, cure blankets may be used.

After exposing decorative aggregate 145 and curing, the process moves to step 222, wherein a sealer is applied to imprinted surface 140 and the exposed decorative aggregate 145 on the surface thereof. In some embodiments, the sealer is a lithium admixture, as described above, and may be integral to the concrete mixture which comprises concrete layer 130, and/or imprinted layer 140. The sealer layer 150 should be applied from about 7 to about 14 days after initial placement of the concrete layer 130 or the imprinted layer 140.

EXAMPLES

Example 1, Concrete Mix

TABLE 1

| Material | Amount |
|---|---|
| Type II-V Cement | 438.8 lbs. |
| Fly Ash F | 103.0 lbs. |
| #57 1' × #4 (CC/CC) | 1,263 lbs. |
| #8⅜" × #8 (CC/CC) | 223 lbs. |
| Fine Aggregate 400WCS (CC/CC) | 1518 lbs. |
| Water | 327 (gal) |
| Type A Water WRDA 64 WR Grace Reducer | 22 oz. |
| HydroMax Internal Cure | 8 oz./yd$^3$ |
| Fibermesh | 4 lbs./yd$^3$ |
| ASR Preventer | 2 lbs./yd$^3$ |

The concrete mixture of Table 1 resulted in a 3000 psi concrete having 3 to 5 inches of slump. The mixture was poured 8:00 am. The mixture was screeded off to the proper elevation. A roller bug applied to the top surface to bring some cream/cement paste to the surface. The 1st bullfloat was applied to the surface 8:30 am. At 8:35 am to 9:00 am aggregates were applied. #00 aggregate applied to the 80% of the concrete surface pneumatically. #0 aggregates applied to the 70% of the concrete surface pneumatically. #01 aggregates applied on 50% of the concrete surface pneumatically. #1 aggregates broadcast on 10% of the concrete surface by hand. #2 aggregates broadcast on 5% of the concrete surface by hand. At 8:45 to 9:15 am, a second bullfloating of the concrete surface was performed to work all the aggregate into the concrete surface working the cement paste up and around all the different size aggregate to insure they are held in place. At 10:30 am, the concrete surface was hand troweled. At 10:45 am, the imprinting process was started. A fishscale granite set pattern was imprinted. At 12:00 pm, a #10 topical retarder (Chemsystem) was applied. The surface was washed the next morning at 7:00 am with a walk behind scrubbing machine (buffer). At 9:00 am SINAK Lithium Cure 1000® was applied. 7 days later 2 coats of SINAK Lithium Cure was applied as a final sealer.

Figure 3:
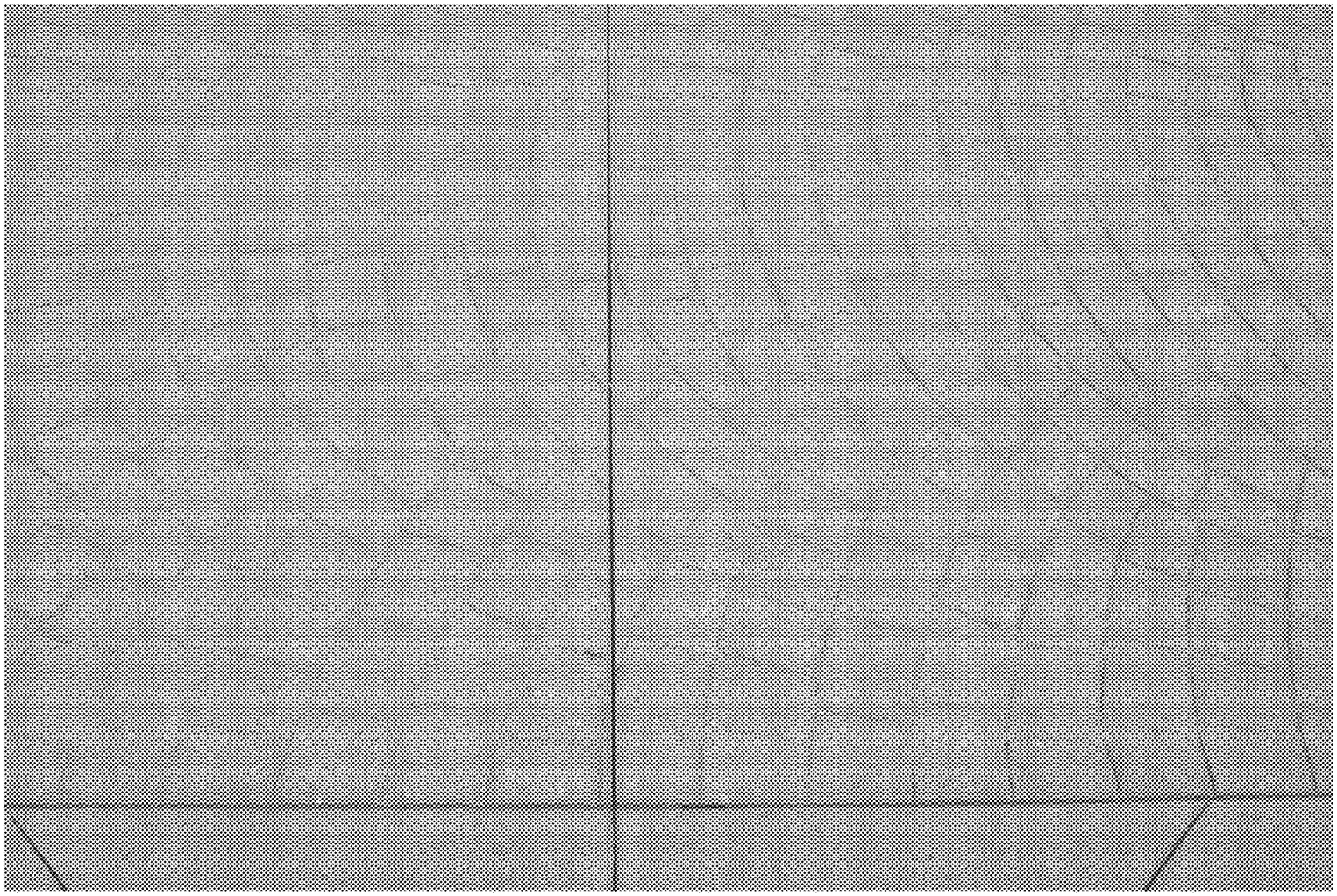
FIGS. 3-9 are photographs illustrating embodiments of imprinted exposed aggregate concrete surfaces.
Figure 4:
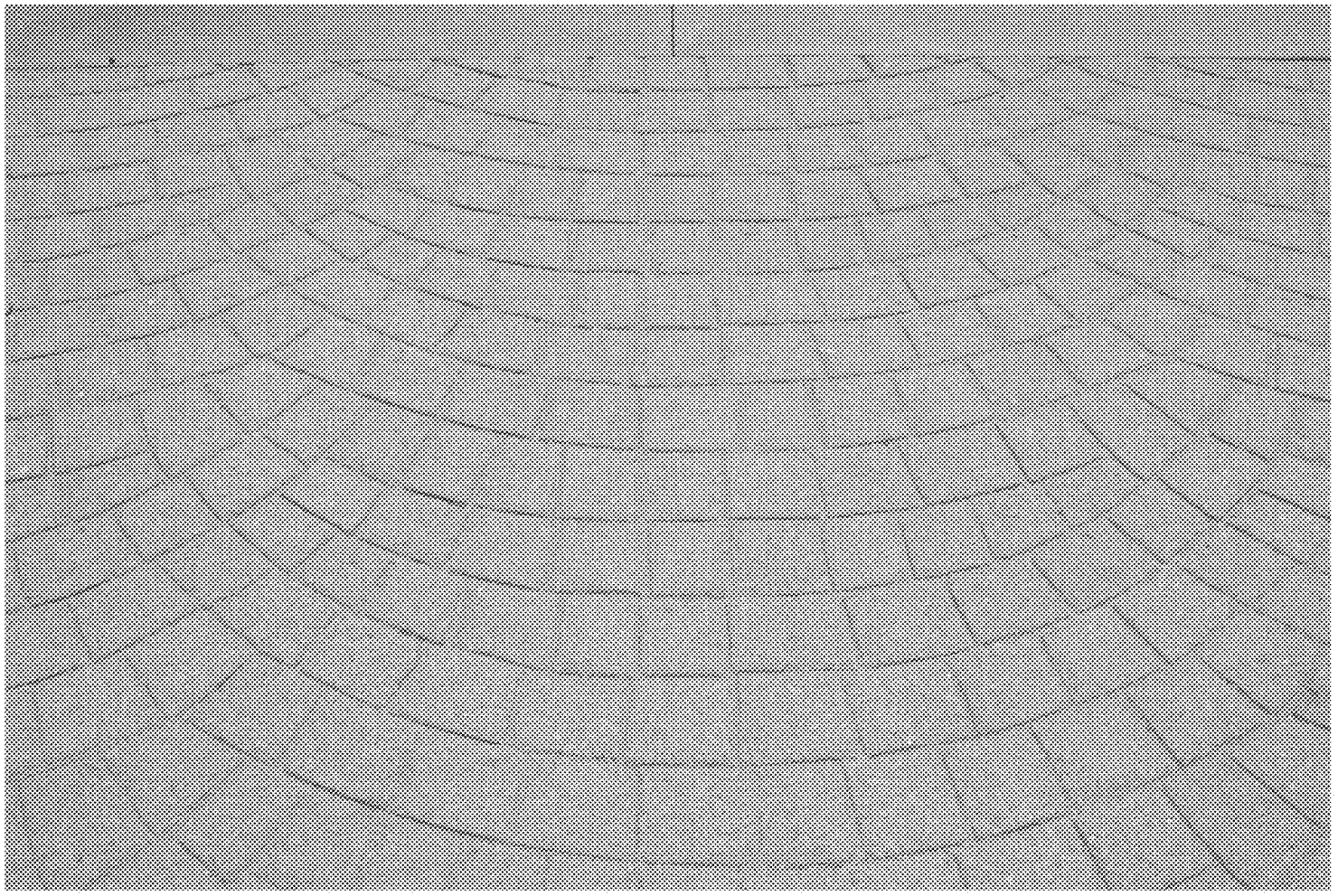
Figure 5:
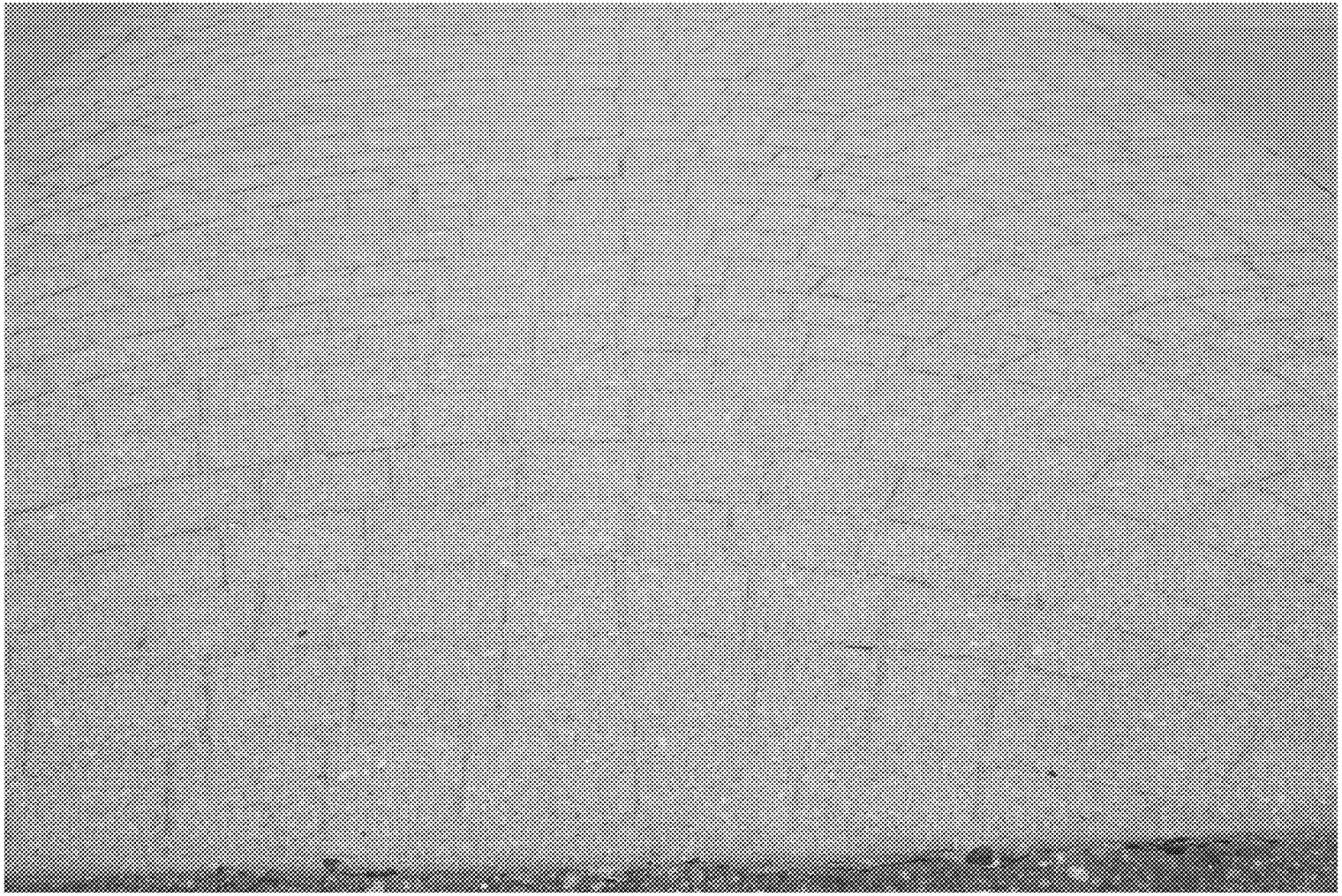
Figure 6:
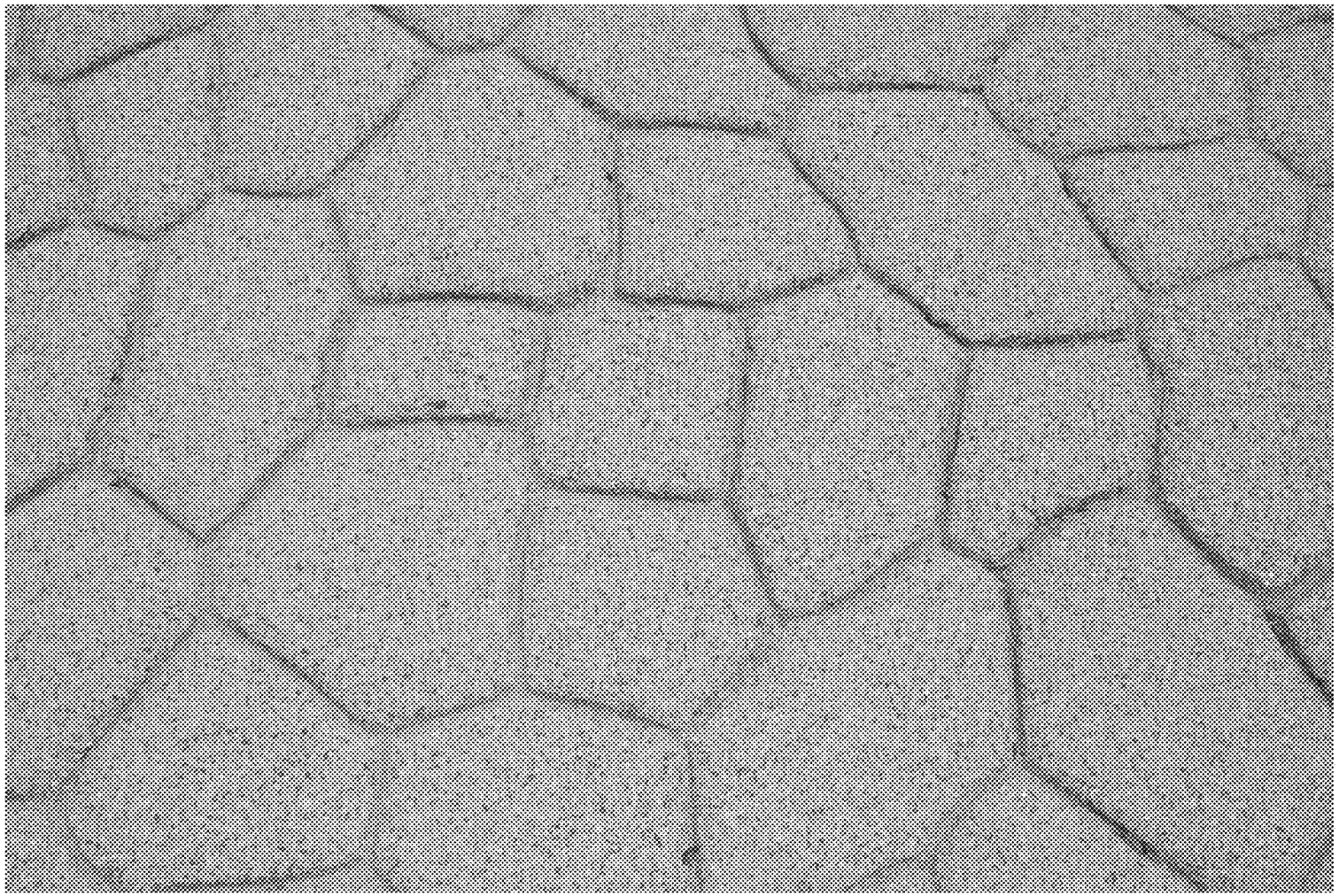
Figure 7:
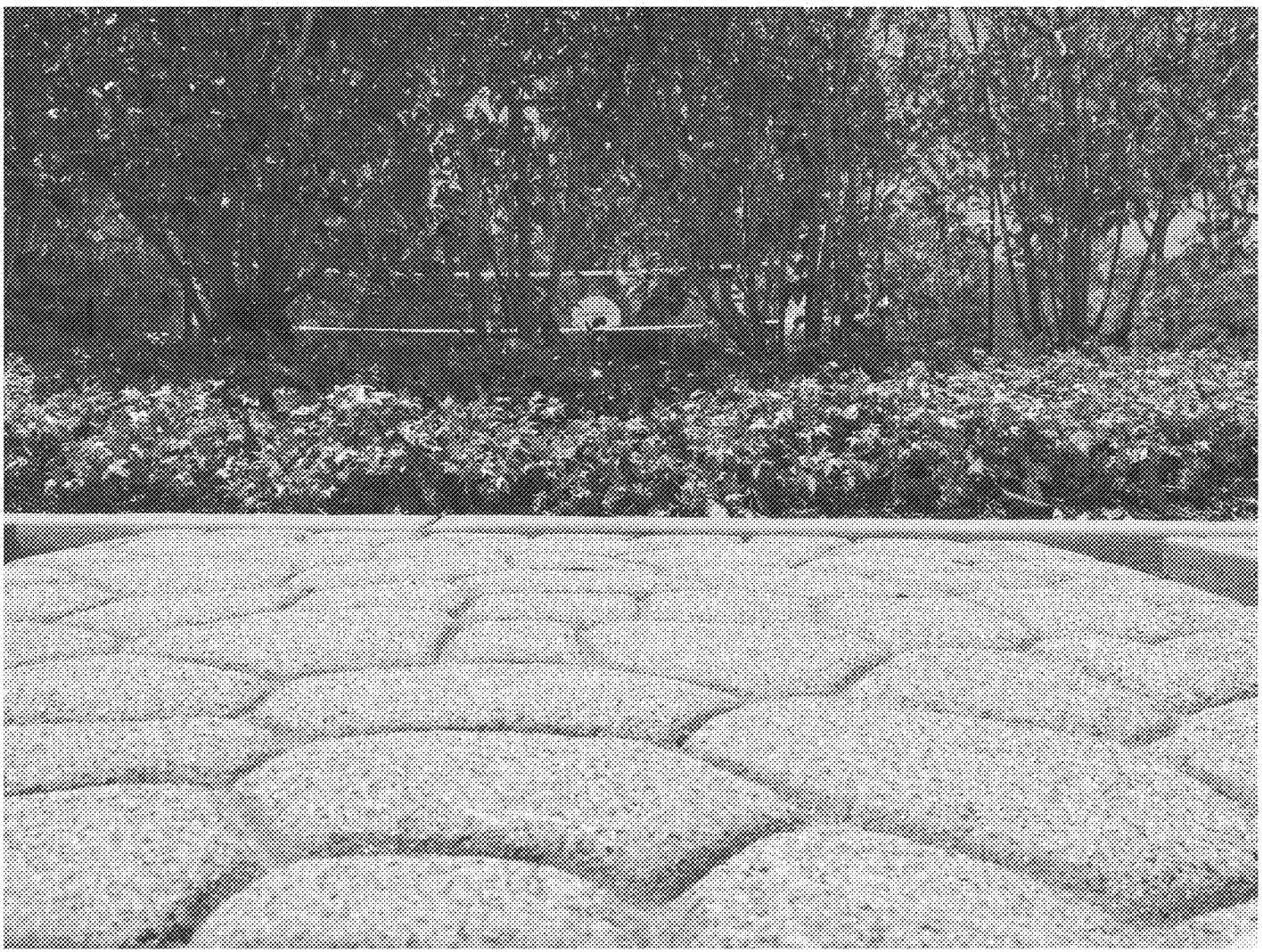
Figure 8:
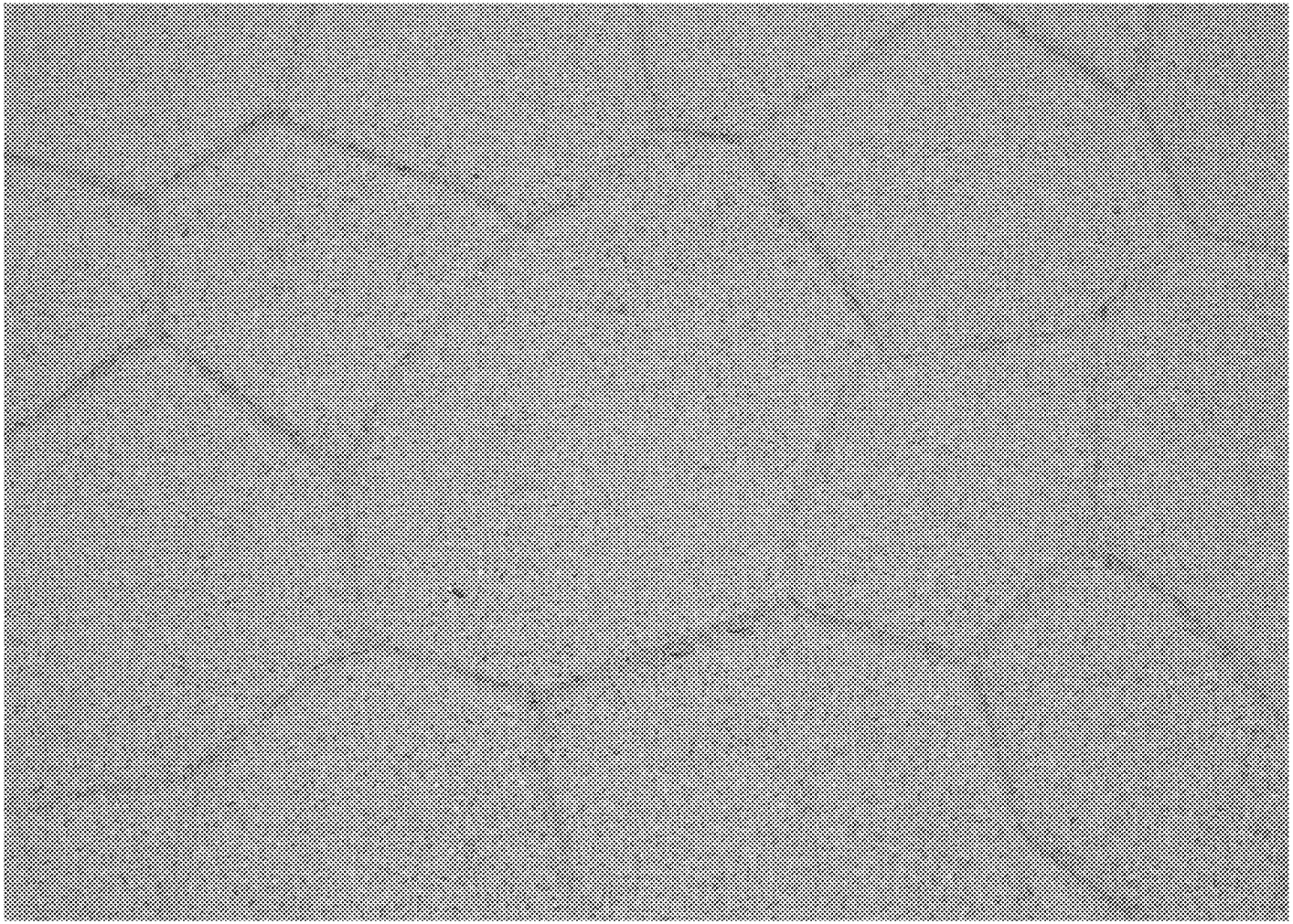
Figure 9:
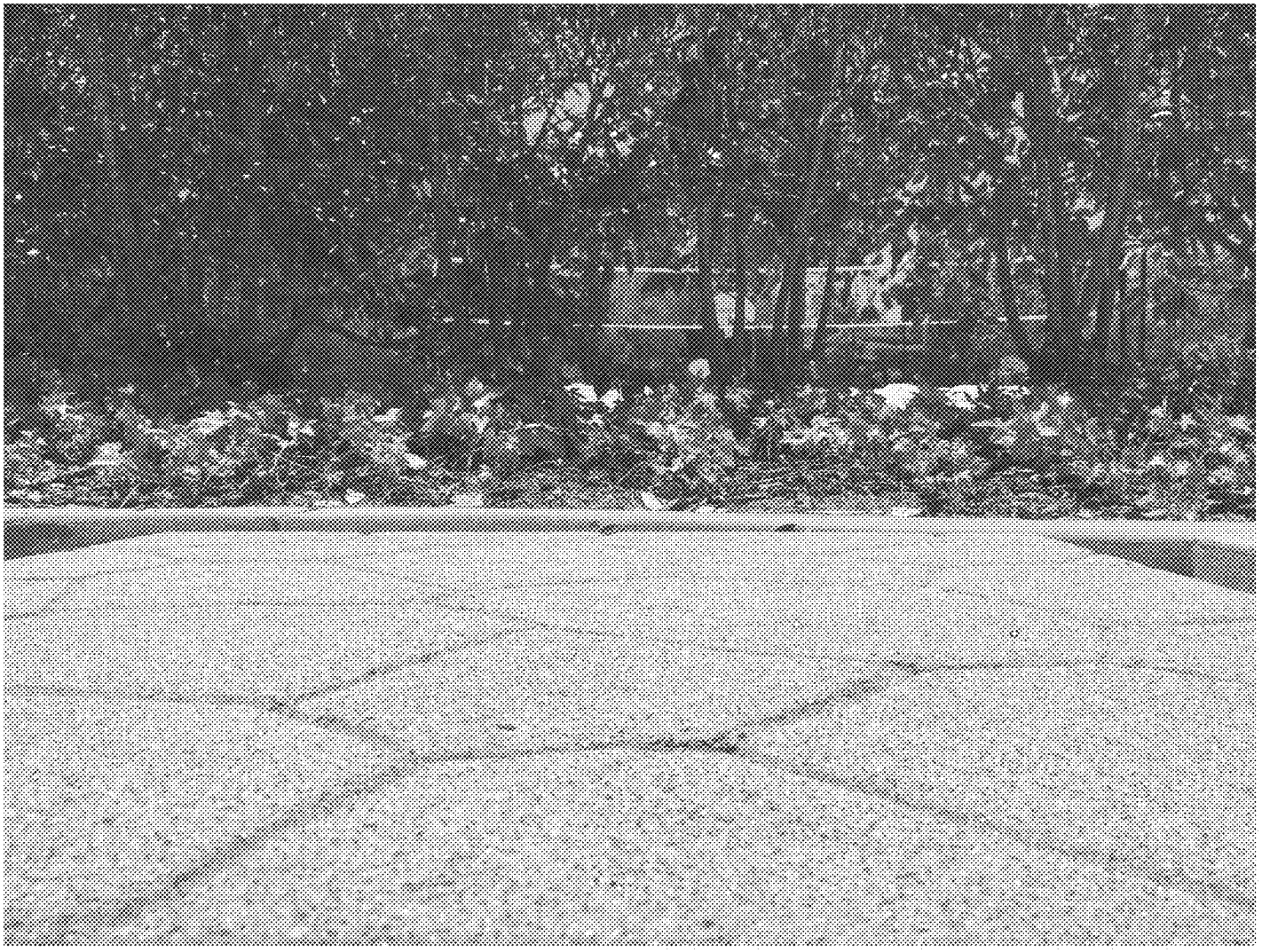

FIGS. 3-9 are photographs illustrating some embodiments of imprinted exposed aggregate concrete surfaces that can be obtained using the methods and systems described herein. FIG. 3 shows a fishscale imprint having an imprinted depth of about ¼" average, with a depth of exposure of about ⅛", using #12-#30 cibola gold sands and aggregates including a #00 and #0 bianco nero granite, #1 cibola oro and puka shell, and a #2 cibola oro. FIGS. 4 and 5 are additional views of the fishscale imprint of FIG. 3. FIG. 6 shows a cobblestone-type imprint having an imprinted depth of about ½" to about ⅝", with a depth of exposure of about ⅛" to about 3/16", using #12-#30 texas black granite sands and aggregates including a #00 bianco nero granite, #0 seafoam granite, #1 mother of pearl, verde granite and bianco nero granite. FIG. 7 shows another view of the imprinted exposed aggregate surface of FIG. 6. FIG. 8 shows a flagstone-type imprint having an imprinted depth of about ¼" to about ½", with a depth of exposure of about 3/16", using #12-#30 umber sands and aggregates including a #00 bianco nero granite, #0 empire state granite, #1 port angeles granite. FIG. 9 shows another view of the imprinted exposed aggregate surface of FIG. 8.

It will be understood by those having skill in the art that the above examples are illustrative only. Quantities and components other than or in addition to those described in these examples may be used without departing from the scope of the present disclosure.

What is claimed is:

1. A method of forming an imprinted concrete system having exposed aggregate comprising:

forming a concrete layer on a sub-grade layer, wherein the concrete layer comprises a cement, a relatively coarse aggregate, and water of hydration;

finishing the concrete layer to form a top surface of the concrete layer;

applying a decorative aggregate to the top surface of the concrete layer;

imprinting the surface of the concrete layer using an imprinting tool;

following imprinting the surface, and without a step of finishing the imprinted surface, retarding curing of a top surface of the imprinted layer by applying a retarder, and allowing a remaining portion of the imprinted layer to cure to a greater extent than the top surface; and waiting a predetermined time, wherein the predetermined time is based on a characteristic of the decorative aggregate; and thereafter mechanically removing at least a portion of the top surface of the imprinted layer to at least partially expose the decorative aggregate; and washing the imprinted layer.

2. The method of claim 1, wherein allowing a remaining portion of the imprinted layer to cure to a greater extent than the top surface comprises waiting a predetermined period of time between applying the retarder and mechanically removing the at least a portion of the top surface.

3. The method of claim 1, wherein the concrete layer further comprises a sealer.

4. The method of claim 1, wherein the concrete layer further comprises an alkali silica reactivity control admixture.

5. The method of claim 1, wherein mechanically removing comprises brushing the surface of the imprinted layer.

6. The method of claim 1, wherein at least partially exposing the decorative aggregate comprises exposing at least a top surface of the decorative aggregate.

* * * * *